US005395230A

United States Patent [19]

Ferguson

[11] Patent Number: 5,395,230

[45] Date of Patent: Mar. 7, 1995

[54] HIGH RATIO MODULATION COMBUSTION SYSTEM AND METHOD OF OPERATION

[75] Inventor: Mark A. Ferguson, Watauga, Tex.

[73] Assignee: PVI Industries, Inc., Fort Worth, Tex.

[21] Appl. No.: 97,651

[22] Filed: Jul. 26, 1993

[51] Int. Cl.[6] ..... F23N 3/00

[52] U.S. Cl. ..... 431/12; 431/70; 431/157

[58] Field of Search ..... 431/12, 20, 157

[56] References Cited

U.S. PATENT DOCUMENTS

| | | | |
|---|---|---|---|
| 2,856,992 | 10/1958 | Bartels . | |
| 3,869,243 | 3/1975 | Creuz | 431/12 |
| 4,299,554 | 11/1981 | Williams . | |
| 4,334,855 | 6/1982 | Nelson . | |
| 4,439,138 | 3/1984 | Craig et al. | 431/12 |
| 4,538,980 | 9/1985 | Hoyme . | |
| 4,717,071 | 1/1988 | Capone | 431/12 |
| 4,938,204 | 7/1990 | Adams | 126/360 R |
| 5,257,574 | 11/1993 | Hiromichi | 431/20 |

*Primary Examiner*—Carroll B. Dority
*Attorney, Agent, or Firm*—Charles D. Gunter, Jr.

[57] ABSTRACT

A combustion system is shown having a combustion chamber into which fuel is introduced and ignited in the presence of air to create products of combustion which are routed through an exhaust vent. A forced draft burner intakes air and fuel and ignites these components to supply heat to the combustion chamber. A valve is provided within the exhaust vent for varying the degree of restriction within the exhaust vent. A modulation drive motor is connected to the variable restriction in the exhaust vent and to the air and fuel supply sources for increasing the exhaust vent back pressure as the ratio of air and fuel being supplied to the combustion chamber are decreased.

8 Claims, 3 Drawing Sheets

HIGH RATIO MODULATION COMBUSTION SYSTEM AND METHOD OF OPERATION

BACKGROUND OF THE INVENTION

1. Field of the Invention

The present invention relates to modulation systems for controlling and coordinating the rate of fuel consumption and delivery of combustion air to gas fired, pressurized combustion appliances.

2. Description of the Prior Art:

Gas or oil-fired equipment modulation can be defined as the control and coordination of both the rate of fuel consumption and the delivery of combustion air to a gas or oil-fired appliance. Such appliances include, for example, water heaters and boilers of the type utilized for commercial/industrial use, as well as for residential use, furnaces, and the like. The objective of the modulation system for such appliances is the maintenance of a consistent air/fuel ratio that results in both good combustion, i.e. minimization of the generation of carbon monoxide, and good efficiency, i.e., the minimization of excess air consistent with good combustion. Prior art modulation systems are known in the art which include three principal components; a modulation drive, a fuel valve and a means to control the rate of combustion air entering the system. Typically, these components are interconnected by a system of linkages that permits adjustment of the air/fuel ratio.

In operation, the known input modulation systems allow the combustion burner to initiate a firing sequence at a minimum rate which promotes smoother ignition and reduced thermal shock. Control of the input rate of air/fuel being supplied to the burner is usually provided by a signal from a differential thermostat. Thus, the greater the difference between a set point of the thermostat (usually the desired output water temperature) and the actual temperature of the stored water, the greater the input rate of the burner. As the temperature differential diminishes, the input rate is proportionately reduced. This behavior represents a key benefit of modulation, i.e., the ability to more closely match input to demand thus reducing the likelihood of short cycling.

The practical input range of a conventional modulation system is limited by flame stability at reduced input. As the rates of fuel and air are reduced, turbulence is also reduced which eventually results in poor mixing and unacceptable combustion, i.e., high carbon monoxide generation. Typically this condition limits the input range of power burners to about 3 or 4 to 1.

The present invention has as its object to provide a high ratio modulation system which substantially increases the input range of power burners for gas fired, pressurized appliances to 10 to 1, or more, by introducing a means to better stabilize the burner flame pattern at a reduced air/fuel input rate.

While the invention will be described with respect to a high efficiency, gas fired water heater, it will be understood that the same principles apply to other gas fired, pressurized appliances such as boilers, furnaces, and the like.

SUMMARY OF THE INVENTION

The combustion system of the invention includes a combustion chamber into which combustible fuel is introduced and ignited in the presence of air to create products of combustion. The combustion chamber has fire tubes which communicate with a flue collector for venting the products of combustion to the atmosphere. A forced draft burner is mounted on the combustion chamber and has an air inlet for the intake of air and a fuel inlet for admitting fuel from a fuel supply source. The forced draft burner also has an ignition means for igniting the air/fuel mixture, thereby supplying heat to the combustion chamber. A pressurized vent creates a positive pressure within the exhaust system leading from the flue collector. A variable restriction means is located within the exhaust vent for varying the degree of restriction, thereby creating a back pressure within the exhaust vent and the combustion passages. Modulating means, associated with the variable restriction means, increases the exhaust vent back pressure as the ratio of air and fuel being supplied to the combustion chamber is decreased, thereby pressurizing the combustion chamber to improve flame stability and increase turbulence within the combustion chamber. The modulating means also deceases the exhaust vent back pressure as the ratio of air and fuel being supplied to the combustion chamber is increased.

Preferably, the combustion system includes a modulation drive, a fuel supply valve for providing combustible fuel from the fuel supply source, an air inlet valve for controlling the supply of air to the burner and a series of mechanical linkages which connect the modulation drive to the air inlet valve of the burner, the fuel supply valve and the exhaust vent restriction means.

In the method of the invention, air is blown into the combustion chamber from an air supply source which includes an air supply valve which regulates the flow rate of air being introduced within the combustion chamber. Combustible fuel is supplied to the combustion chamber from a fuel supply source including a fuel supply valve. An ignition means is provided for igniting the air/fuel mixture, thereby supplying heat to the combustion chamber. A variable restriction means mounted within the exhaust vent allows the creation of a back pressure within the exhaust vent and the combustion chamber to increase flame stability and mixing within the combustion chamber, thereby allowing improved combustion at lower fuel/air input rates. The restriction means in the exhaust vent is modulated along with the supply of air and fuel to the combustion chamber so that the exhaust vent back pressure is increased as the ratio of air and fuel being supplied to the combustion chamber is decreased and so that the exhaust vent back pressure is decreased as the ratio of air and fuel being supplied to the combustion chamber is increased.

Additional objects, features and advantages will be apparent in the written description which follows.

DETAILED DESCRIPTION OF THE INVENTION

The typical prior art for gas, oil or gas/oil fired water heaters featured non-pressurized external combustion chambers. The location of the combustion chamber on the exterior of the water heater resulted in lost heat and relatively low thermal efficiency. U.S. Pat. No. 4,938,204, issued Jul. 3, 1990, and assigned to the assignee of the present invention, describes a water heater design which features a submergable, pressurized combustion chamber so that all combustion takes place in the water heater tank interior in a chamber surrounded by water. The submerged combustion chamber, along with a submerged heat exchanger, produce a near stoichometric combustion with a resulting fuel-to-water thermal efficiency which exceeds 98%. The extremely high efficiency of the device leads to a major reduction in the temperature of the combustion products being created, allowing the exhaust products to be vented, for example, through PVC conduit. Because the physical effects that tend to naturally vent combustion products are no longer as intense, the device features a positive pressure vent to expel combustion products. The high ratio modulation system of the invention is well adapted for use with such a water heater design, although it will be understood from the description which follows that the present invention has application to a wide range of forced draft/gas fired appliances having variable vent pressure.

Figure 1:
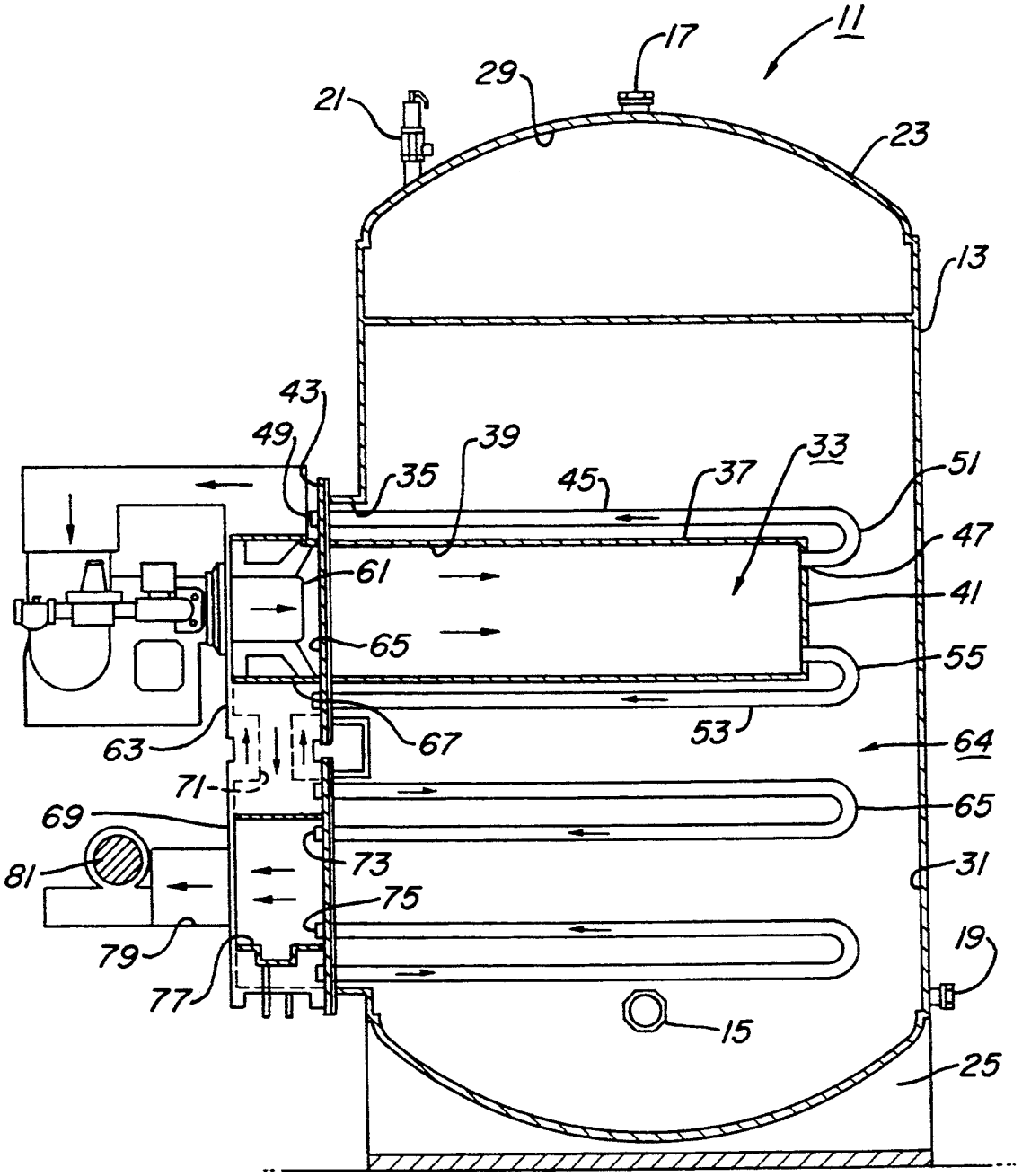
FIG. 1 is a side, schematic view of a singe tank water heater of the invention showing the circulation of combustion air and products of combustion through the internal components of the apparatus.

Turning to FIG. 1, there is shown a water heater suitable for use with the modulation system of the invention, designated generally as 11. The water heater 11 includes a storage tank 13 with a normally closed interior containing water under pressure. The tank 13 has a cold water inlet 15, a hot water outlet 17, a drain valve 19 and a safety pressure release valve 21. The tank 13 is provided with a generally cylindrical body portion having heads or closures on both ends, such as head 23 and a stabilizer skirt 25. The tank interior is divided into an upper region 29 and a lower region 31.

A submergible, pressurized combustion chamber assembly, designated generally as 33, is adapted to be received within a primary sidewall opening 35 in tank 13. The submergible portion of the assembly includes a combustion chamber portion 37 adapted to be received within the tank opening 35. Submergible combustion chamber portion 37 comprises a cylindrical elongated member having an open end 67 and having an opposite closed end 41. The combustion chamber assembly 33 also includes a mounting portion for detachably engaging the tank opening 35 for mounting the assembly 33 within the tank. The mounting portion can conveniently comprise a tube mounting flange 43 located adjacent and connected to a tank opening flange. The tube mounting flange 43 can be a ring-like body having an opening in the central part thereof which opening coincides with the opening in open end 67 of the combustion chamber 37. The flange 43 is securely affixed to the chamber 37.

The combustion chamber assembly 33 also includes a plurality of curved fire tubes 45 each of which has an end 47 which communicates with the combustion chamber 37 through closed end 41 and which has an opposite end 49 which extends through the opening 35 when in place on tank 13 to the tank exterior. Each of the curved tubes is characterized in that at least a portion 51 of the length thereof is generally U-shaped. The configuration shown in FIG. 1 has a combustion chamber 37 which extends substantially the length of the curved fire tubes 45 creating a long leg 53 running along the exterior of the combustion chamber 37 and separated by U-shaped portion 51 from a short leg 55 which joins and extends through a closed end 41.

The ends 49 of the curved tubes 45 preferably extend to the tube mounting flange 43 and communicate through flange 43 when the assembly 33 is received within the primary sidewall opening 35. The tube ends 49 are secured to the flange 43. Although a small number of curved tubes 45 are shown in FIG. 1, for simplicity, a greater number of tubes and openings are typically used in practice.

The combustion chamber assembly 33 can be mounted on the tank 13 in any convenient fashion. For example, the tank can be provided with a tank mounting flange comprising a cylindrical ring which is fixedly connected to the tank exterior so as to circumscribe the opening 35 in tank 13 and to extend outwardly therefrom generally normal to the vertical sidewalls of the tank 13. The end area of the tank mounting flange can be provided with a plurality of bores which are suitably spaced and alignable with matching bores in the tube flange whereby the fire tube assembly can be bolted to the tank mounting flange.

A flue collector 63 is mounted on tube mounting flange 43 and has an opening 65 which communications with combustion chamber portion 37 and an annular chamber 67 which communications with the fire tubes 45 by means of openings in the flange 43.

A heat source, such as burner nozzle 61 from an air fed, forced draft burner is provided with a series of holes which mate with and receive lugs for bolting the nozzle 61 onto the flue collector 63. In this way, the nozzle burner opening can communicate with the combustion chamber assembly 37, whereby heat from the burner passes through the interior of the submerged combustion chamber and through the fire tubes 45 into the annular chamber of the flue collector 63.

A secondary heat exchange means, such as heat exchanger 64 is provided in the tank 13 for preheating the cool water entering the inlet 15 in the lower region 31 of the tank 13. The heat exchanger 64 has at least one heat exchange tube 65 which extends through a secondary sidewall opening 35 provided in the tank 13 so that the heat exchange tube 65 is submerged in the water under pressure. Preferably, a plurality of heat exchange tubes 65 are provided. As shown in FIG. 1, the heat exchanger 64 is provided with a secondary flue collector 69 similar to the primary flue collector. Passage means 71 connect the primary and secondary flue collectors, whereby the products of combustion generated by the forced draft burner in the combustion chamber 37 are supplied to the heat exchange tubes 65 and the secondary heat exchanger 64. The heat exchange tubes 65 are preferably U-shaped with the products of combustion exiting the tube ends 73, 75 and passing through the central opening 77 in the secondary flue collector to an outlet 79 to be exhausted from the tank. An exhaust fan or power vent 81 assists in pulling the products of combustion from the combustion chamber through the primary and secondary flue collectors and out the exhaust outlet 79.

Figure 2:
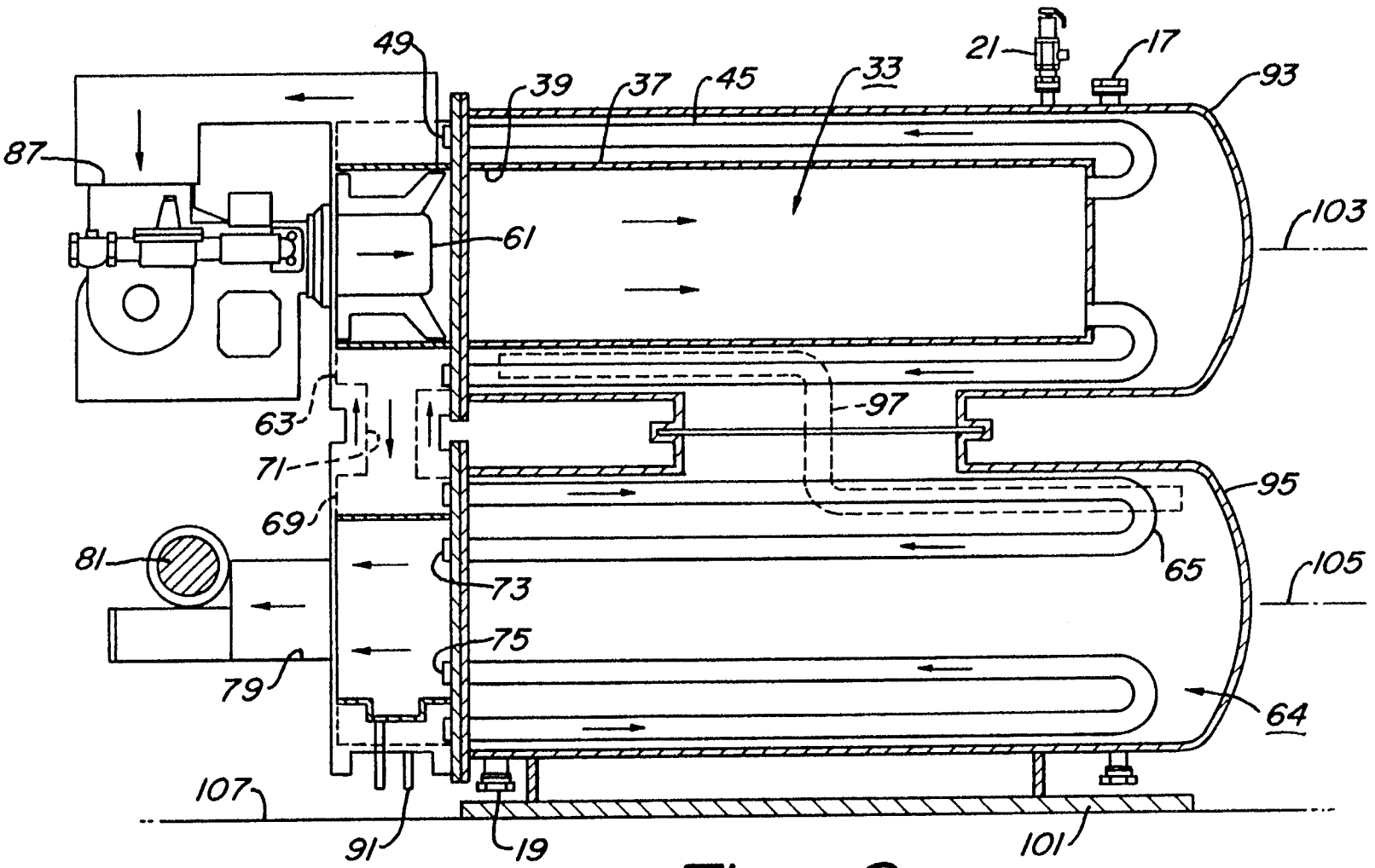
FIG. 2 is a side, schematic view similar to FIG. 1 but showing a dual tank water heater of the invention.

FIG. 2 illustrates another embodiment of the water heating appliance of the invention which features a dual water storage tank arrangement. The submergible, pressurized combustion chamber assembly 33 is mounted within a storage tank 93 while the secondary heat exchanger 64 is mounted within a separate preheat tank 95. A crossover tube assembly 97 establishes fluid communication between the preheat tank 95 and the storage tank 93. The preheat and storage tanks are supported by a base 101 on a surrounding support surface 107, such as the floor. Each of the tanks has a longitudinal axis 103, 105 which are parallel to the plane of the surrounding support surface 107. Preferably, the storage tank 93 is mounted on the base 101 over the preheat tank 95 in vertical fashion with the axes 103, 105 extending in parallel planes with respect to the support surface 107. In all other respects, the operation of the water heater of FIG. 2 is identical to that of FIG. 1. That is, the products of combustion created in the chamber portion 37 pass out the curved fire tubes 45 to the primary flue collector and through the passage means to the secondary flue collector where they are routed through the heat exchange tubes 65. The products of combustion are then routed through the central opening of the secondary flue collector to the exhaust outlet 79.

Water heating devices of the above type are commercially available from PVI Industries, Inc. of Fort Worth, Texas, as the "TURBOPOWER 99."

Figure 3:
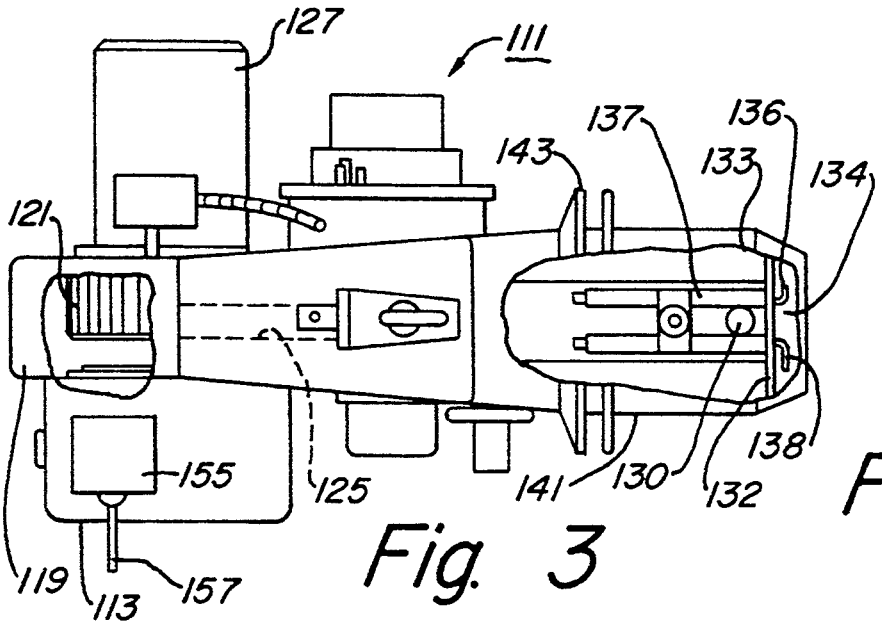
FIG. 3 is an isolated view of the forced draft burner used with the water heaters of FIGS. 1 and 2.
Figure 3A:
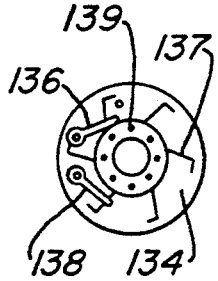
FIG. 3*a* is an end view of the nozzle area of the forced draft burner of FIG. 3 showing the pressure plate and electrodes thereof.

FIGS. 3 and 3*a* show an air fed, forced draft burner, designated generally as 111, suitable for use in the combustion system of the invention. The burner 111 can be fueled with propane, natural gas or oil, but is preferably fueled by natural gas for purposes of the present invention. The burner 111 has the capability to create an over fire pressure within the combustion chamber. Flame temperatures for such burners are in the range of about 1900° F., or higher.

Figure 4:
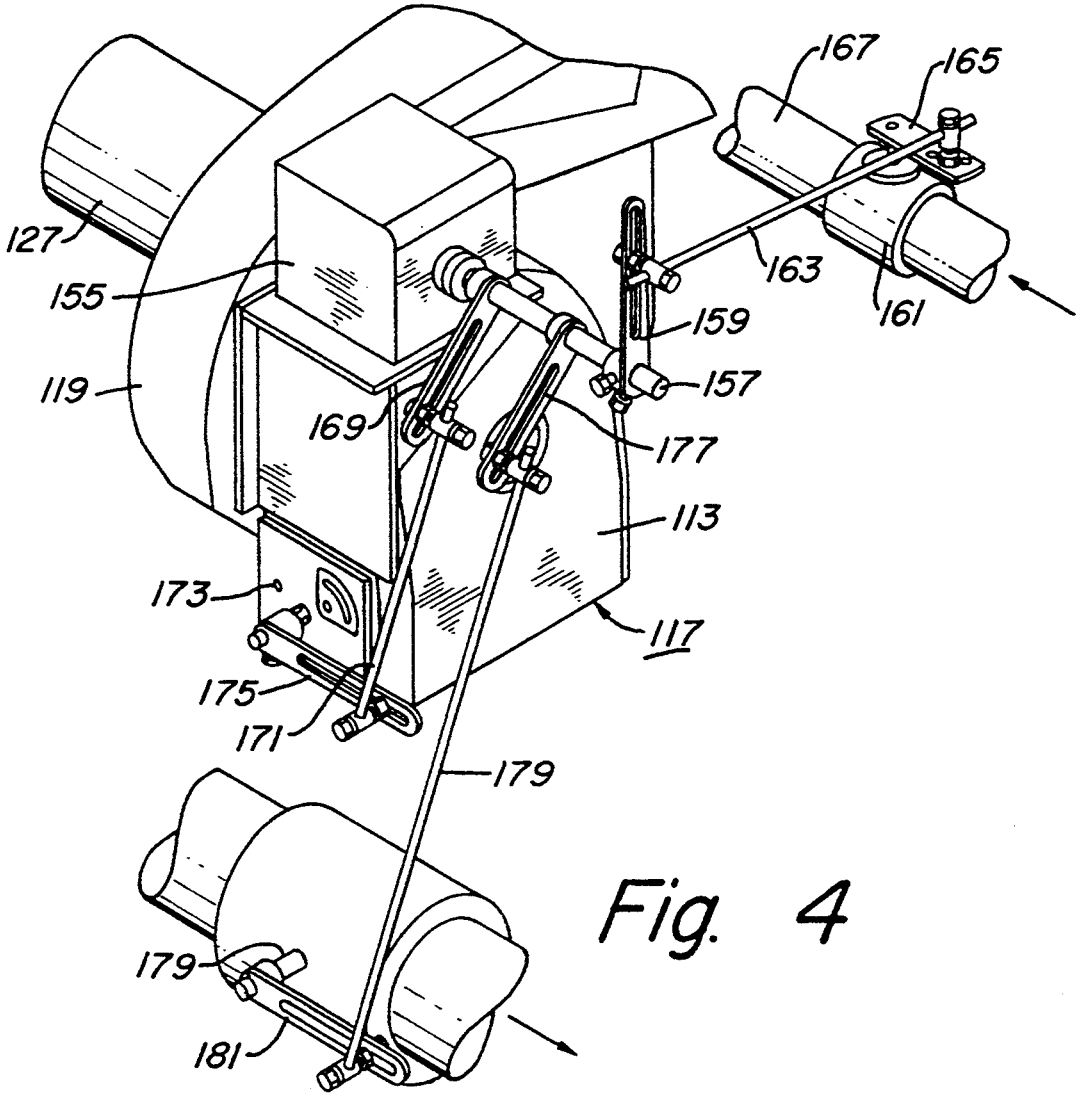
FIG. 4 is an isolated, isometric view of the modulation system used with the water heater device of FIGS. 1 and 2.

As shown in FIGS. 3 and 4, the burner 111 includes an air intake shroud 113 which has an air intake opening 117 which communicates with the burner impeller housing 119 and a fuel/air mixing passage 125. The air intake opening can open directly to the local environment or connect to an air conduit that supplies fresh outside air, such as a pipe or duct.

The impeller housing 119 contains a motor-driven impeller 121, driven by motor 127, which impels air from the air intake opening 117 into the fuel/air mixing passage 125. The fuel/air mixing passage 125 terminates at the first face 132 of a pressure plate 133. Pressure plate 133 also has a second, oppositely arranged face 134 (FIG. 3*a*) onto which is mounted an ignition means such as electrodes 136, 138. Gas is supplied from a suitable source (not shown) to primary gas ports 130 located upstream of pressure plate 133 and to secondary gas ports 139 located on the opposite face 134 of the pressure plate. The pressure plate 133 has openings 137 to allow passage of the highly pressurized, air/fuel mixture from the fuel/air mixing passage 125.

Nozzle 141 directs the resulting flame from the burner 111 to the submerged combustion chamber of the water heater 11. The nozzle 141 can be either a portion of the housing 119 or a separate piece that connects to the housing. The burner 111 can be attached to the tank (13 in FIG. 1) in any convenient manner.

As shown in FIG. 4, a modulation system drive motor 155 is mounted upon the air intake shroud 113. The drive motor 155 can be electrically powered and has an output shaft 157. The output shaft 157 has connected thereto a first crank arm 159 which is, in turn, connected to a fuel valve mechanism 161 by means of a tie rod 163 and a second crank arm 165. The valve mechanism 161 could be, for example, a butterfly valve located within the fuel supply conduit 167 which supplies fuel to the power burner 111. A third crank arm 169 is connected to the output shaft 157 and through a tie rod 171 to an air inlet valve 173 for the air intake shroud 113. The valve 173 can be a simple shutter valve mechanism with the angle of the crank arm 175 determining the relative amount of air allowed to enter the air intake 117.

The output shaft 157 of the modulation drive motor 155 is also connected by means of a crank arm 177 and a tie rod 179 to a variable restriction means located within the exhaust vent downstream of the exhaust fan 81 for creating a back pressure within the exhaust vent and in the combustion chamber of the device. The variable restriction means can comprise a vent damper 179, the position of which is determined by the position of crank arm 181. Since each of the crank arms 159, 169, and 177 is fixed to the output shaft 157, the drive motor 155 constitutes a modulating means associated with the variable restriction means in the exhaust vent for increasing the exhaust vent back pressure as the ratio of air and fuel being supplied to the combustion chamber is decreased and for decreasing the exhaust vent back pressure as the ratio of air and fuel being supplied is increased. The modulation system drive motor 155 can be controlled based upon a set point, such as the desired output temperature of the device, using known control theory. For an example discussion of a simple temperature-based controller, see the text "Process Systems Analysis And Control", McGraw-Hill, 1965, Chapter 10.

In operation, air is blown into the combustion chamber by means of burner 111 and impeller 121. The air supplied through the air intake opening 117 of the shroud 113 is controlled by means of the air supply valve 173 which regulates the flow rate of air being introduced into the combustion chamber. The combustible fuel being supplied through the conduit 167 is controlled by means of the fuel supply valve 161, the air/fuel mixture being ignited by means of the electrodes 136, 138 for supplying heat to the combustion chamber. The vent damper 179 in the exhaust vent is used to vary the degree of restriction within the exhaust vent, thereby creating a back pressure within the exhaust vent and the combustion chamber as the ratio of air and fuel being supplied to the burner is decreased. The modulation drive motor 155 and mechanical linkages provide a modulating means for increasing the exhaust vent back pressure as the ratio of air and fuel being supplied to the combustion chamber is decreased and for decreasing the exhaust vent back pressure as the ratio of air and fuel being supplied to the combustion chamber is increased.

An invention has been provided with a number of advantages. The combustion system of the invention permits an appliance to fire at a rate at least about 90% below its maximum input. The variable restriction means in the exhaust vent pressurizes the combustion gases to stabilize the flame pattern within the combustion area of the device, allowing more precise metering of air and fuel, especially at reduced rates of flow. The method of the invention maintains a nearly constant ratio of air and fuel throughout the input range of the device to optimize efficiency. The modulation system substantially increases the input range of the device (to as much as about 10:1) by better stabilization of the flame pattern at reduced input.

While the invention has been shown in only one of its forms, it is not thus limited but is susceptible to various changes and modifications without departing from the spirit thereof.

What is claimed is:

1. In a combustion system of the type having a combustion chamber into which combustible fuel is introduced and ignited in the presence of air to create products of combustion and having an exhaust vent communicating with the combustion chamber for venting the products of combustion from the combustion chamber to the atmosphere, the improvement comprising:

a forced draft burner mounted on the combustion chamber having an air inlet for the intake of air and a fuel supply source, the forced draft burner also having an ignition means associated therewith for igniting air and combustible fuel for supplying heat to the combustion chamber;

a fan for creating a positive pressure within the exhaust vent;

a variable restriction means located within the exhaust vent for varying the degree of restriction within the exhaust vent, thereby creating a back pressure within the exhaust vent and the combustion chamber;

modulating means associated witch the variable restriction means, for increasing the exhaust vent back pressure as the ratio of air and fuel being supplied to the combustion chamber is decreased, thereby preloading the combustion chamber to improve flame stability and increase turbulence within the combustion chamber; and wherein the modulating means further comprises a modulation drive motor, a fuel supply valve for providing combustible fuel from the fuel supply source, an air inlet valve for controlling the supply of air to the burner and a series of mechanical linkages which connect the modulation drive motor to the air inlet valve of the burner, the fuel supply valve and the exhaust vent restriction means.

2. In a water heating device of the type having contiguous walls which define a closed tank normally containing water under pressure and having a submerged combustion chamber into which combustible fuel is introduced and ignited in the presence of air to create products of combustion and having an exhaust vent communicating with the combustion chamber for venting the products of combustion from the combustion chamber to the atmosphere, the improvement comprising:

a forced draft burner mounted on the exterior of the closed tank and having a nozzle which extends through an opening in a tank wall to the submerged combustion chamber, the forced draft burner having an air inlet for the intake of air and a fuel supply valve for providing combustible fuel from a fuel supply source, the forced draft burner also having an ignition means associated therewith for igniting air and combustible fuel and supplying heat to the combustion chamber;

a fan for creating a positive pressure within the exhaust vent;

a variable restriction means located within the exhaust vent for varying the degree of restriction within the exhaust vent, thereby creating a back pressure within the exhaust vent and the combustion chamber;

modulating means associated with the variable restriction means for increasing the exhaust vent back pressure as the ratio of air and fuel being supplied to the combustion chamber is decreased, thereby preloading pressure within the combustion chamber to improve flame stability and increase turbulence as air and fuel are mixed within the combustion chamber; and wherein the modulating means further comprises a modulation drive motor, a fuel supply valve for providing combustible fuel from the fuel supply source, an air inlet valve for controlling the supply of air to the burner and a series of mechanical linkages which connect the modulation drive motor to the air inlet valve of the burner, the fuel supply valve and the exhaust vent restriction means.

3. The water heating device of claim 2, wherein the submerged combustion chamber has multiple external heating surfaces, the submerged combustion chamber being mounted within the tank by mounting means to extend through a wall of the closed tank so that all of the multiple external heating surfaces are submerged in the water in the tank under pressure.

4. The water heating device of claim 3, wherein the combustion chamber comprises a substantially cylindrical body portion having an open end located adjacent the mounting means which communicates with the exterior of the closed tank, the combustion chamber also having a closed end at the opposite end of the body portion.

5. The water heating device of claim 4, wherein the multiple external heating surfaces are a plurality of fire tubes each of which has a short leg which extends through the closed end of the body portion to communicate with the interior of the combustion chamber and a long leg which extends adjacent the body portion through the mounting means.

6. The water heating device of claim 5, wherein a primary flue collector is mounted on the exterior of the closed tank having a flue opening therein which communicates with the open end of the body portion of the combustion chamber, the primary flue collector having an annular chamber surrounding the flue opening and separated therefrom, the annular chamber communicating with the long leg of each of the fire tubes through the mounting means.

7. The water heating device of claim 6, wherein the burner nozzle is mounted through the flue opening of the primary flue collector, wherein heat from the burner nozzle passes through the combustion chamber and through the fire tubes into the primary flue collector.

8. A method for improving the combustion characteristics of a combustion system of the type having a combustion chamber into which combustible fuel is introduced and ignited in the presence of air to create products of combustion and having an exhaust vent communicating with the combustion chamber for venting the products of combustion from the combustion chamber to the atmosphere, the method comprising the steps of:

mounting a forced draft burner on the combustion chamber and providing the burner with an air inlet for the intake of air and a fuel supply valve for providing combustible fuel from a fuel supply source;

providing the forced draft burner with an ignition means for igniting air and combustible fuel and supplying heat to the combustion chamber;

mounting a fan for creating a positive pressure within the exhaust vent;

mounting a variable restriction means within the exhaust vent downstream of the exhaust fan for varying the degree of restriction within the exhaust vent, thereby creating a back pressure within the exhaust vent and the combustion chamber;

providing modulating means for increasing the exhaust vent back pressure as the ratio of air and fuel being supplied to the combustion chamber is decreased, thereby pressurizing the combustion chamber to improve flame stability and increase turbulence within the combustion chamber.

* * * * *